US011517176B2

(12) United States Patent
Brewer et al.

(10) Patent No.: US 11,517,176 B2
(45) Date of Patent: Dec. 6, 2022

(54) DISHWASHING APPLIANCE CABLE MOTOR MOUNT

(71) Applicant: Haier US Appliance Solutions, Inc., Wilmington, DE (US)

(72) Inventors: Kyle James Brewer, Louisville, KY (US); Mark Thomas Fryman, Louisville, KY (US); Craig Curtis, Crestwood, KY (US); Steven Chadwick Koepke, La Grange, KY (US); Scott Allen Noll, Blacklick, OH (US); Luke Thomas Fredette, London, OH (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 127 days.

(21) Appl. No.: 17/076,993

(22) Filed: Oct. 22, 2020

(65) Prior Publication Data

US 2022/0125273 A1 Apr. 28, 2022

(51) Int. Cl.
*A47L 15/22* (2006.01)
*A47L 15/42* (2006.01)

(52) U.S. Cl.
CPC ..... *A47L 15/4246* (2013.01); *A47L 15/22* (2013.01); *A47L 15/4219* (2013.01)

(58) Field of Classification Search
None
See application file for complete search history.

(56) References Cited

U.S. PATENT DOCUMENTS

| | | | | |
|---|---|---|---|---|
| 2,813,543 | A | 11/1957 | Richard | |
| 8,985,128 | B2 | 3/2015 | Jin | |
| 10,064,537 | B2 | 9/2018 | Welch | |
| 10,499,788 | B2 | 12/2019 | Borgerson | |
| 2011/0315174 | A1* | 12/2011 | Pyo | A47L 15/4246 134/186 |

FOREIGN PATENT DOCUMENTS

| | | | |
|---|---|---|---|
| EP | 1956263 | A1 | 8/2008 |
| KR | 20050105719 | A | 11/2005 |

* cited by examiner

*Primary Examiner* — Levon J Shahinian
(74) *Attorney, Agent, or Firm* — Dority & Manning, P.A.

(57) ABSTRACT

A dishwashing appliance includes a tub defining a wash chamber for receipt of articles for washing. A sump is a sump positioned at a bottom of the wash chamber for receiving fluid from the wash chamber. A circulation pump is connected to the sump. The dishwashing appliance also includes a mounting cable extending from the circulation pump. The circulation pump is suspended by the mounting cable.

16 Claims, 8 Drawing Sheets

DISHWASHING APPLIANCE CABLE MOTOR MOUNT

FIELD OF THE INVENTION

The present subject matter relates generally to dishwashing appliances, and more particularly to features and methods for mounting a motor to a sump in a dishwashing appliance.

BACKGROUND OF THE INVENTION

Dishwashing appliances generally include a tub that defines a wash chamber. Rack assemblies can be mounted within the wash chamber of the tub for receipt of articles for washing. Multiple spray assemblies can be positioned within the wash chamber for applying or directing wash liquid (e.g., water, detergent, etc.) towards articles disposed within the rack assemblies in order to clean such articles. After being applied or directed towards the rack assemblies and/or articles therein, the wash liquid generally flows by gravity to or towards a bottom of the wash chamber, such as to a sump positioned at the bottom of the wash chamber. Dishwashing appliances are also typically equipped with one or more pumps, such as a circulation pump or a drain pump, for directing or motivating wash liquid from the sump to, e.g., the spray assemblies or an area outside of the dishwashing appliance.

Conventionally, the circulation pump is rigidly connected to the sump. Such rigid connections may readily transfer vibrations from the circulation pump to the sump, resulting in potentially excessive noise generation. Additionally, conventional means of connecting the circulation pump to the sump require multiple, e.g., three or more, connection points, which can increase the time consumed and difficulty of installing the circulation pump and/or sump.

Accordingly, dishwashing appliances that include features for mounting a circulation pump that address one or more of the challenges noted above would be useful.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a dishwashing appliance is provided. The dishwashing appliance defines a vertical direction. The dishwashing appliance includes a tub defining a wash chamber for receipt of articles for washing and a sump positioned at a bottom of the wash chamber for receiving fluid from the wash chamber. The dishwashing appliance also includes a circulation pump connected to the sump. A mounting cable extends from the circulation pump, such that the circulation pump is suspended along the vertical direction by the mounting cable.

In another exemplary aspect of the present disclosure, a dishwashing appliance is provided. The dishwashing appliance includes a tub defining a wash chamber for receipt of articles for washing and a sump positioned at a bottom of the wash chamber for receiving fluid from the wash chamber. The dishwashing appliance also includes a circulation pump connected to the sump. A mounting cable extends from the circulation pump, such that the circulation pump is suspended from one of the tub or the sump by the mounting cable.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
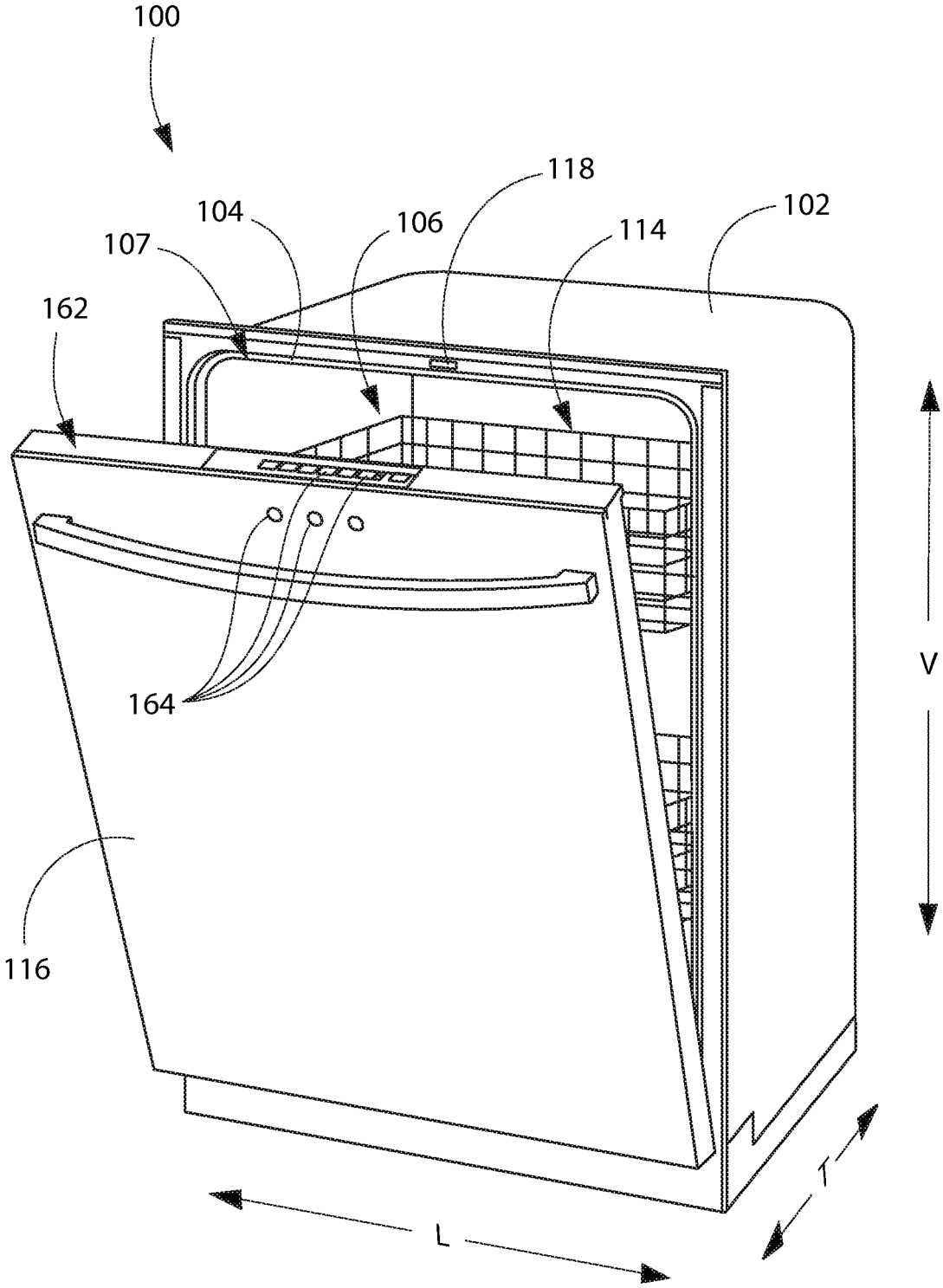
FIG. 1 provides a perspective view of an exemplary embodiment of a dishwashing appliance of the present disclosure with a door in a partially open position.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the term "or" is generally intended to be inclusive (i.e., "A or B" is intended to mean "A or B or both"). The terms "first," "second," and "third" may be used interchangeably to distinguish one component from another and are not intended to signify location or importance of the individual components. The terms "upstream" and "downstream" refer to the relative flow direction with respect to fluid flow in a fluid pathway. For instance, "upstream" refers to the flow direction from which the fluid flows, and "downstream" refers to the flow direction to which the fluid flows. The term "article" may refer to, but need not be limited to dishes, pots, pans, silverware, and other cooking utensils and items that can be cleaned in a dishwashing appliance. The term "wash cycle" is intended to refer to one or more periods of time during which a dishwashing appliance operates while containing the articles to be washed and uses a wash liquid (e.g., water, detergent, or wash additive). The term "rinse cycle" is intended to refer to one or more periods of time during which the dishwashing appliance operates to remove residual soil, detergents, and other undesirable elements that were retained by the articles after completion of the wash cycle. The term "drain cycle" is intended to refer to one or more periods of time during which the dishwashing appliance operates to discharge soiled water from the dishwashing appliance. The term "wash liquid" refers to a liquid used for washing or rinsing the articles that is typically made up of water and may include additives, such as detergent or other treatments (e.g., rinse aid). Furthermore, as used herein, terms of approximation, such as "approximately," "substantially," or "about," refer to being within a ten percent (10%) margin of error.

Figure 2:
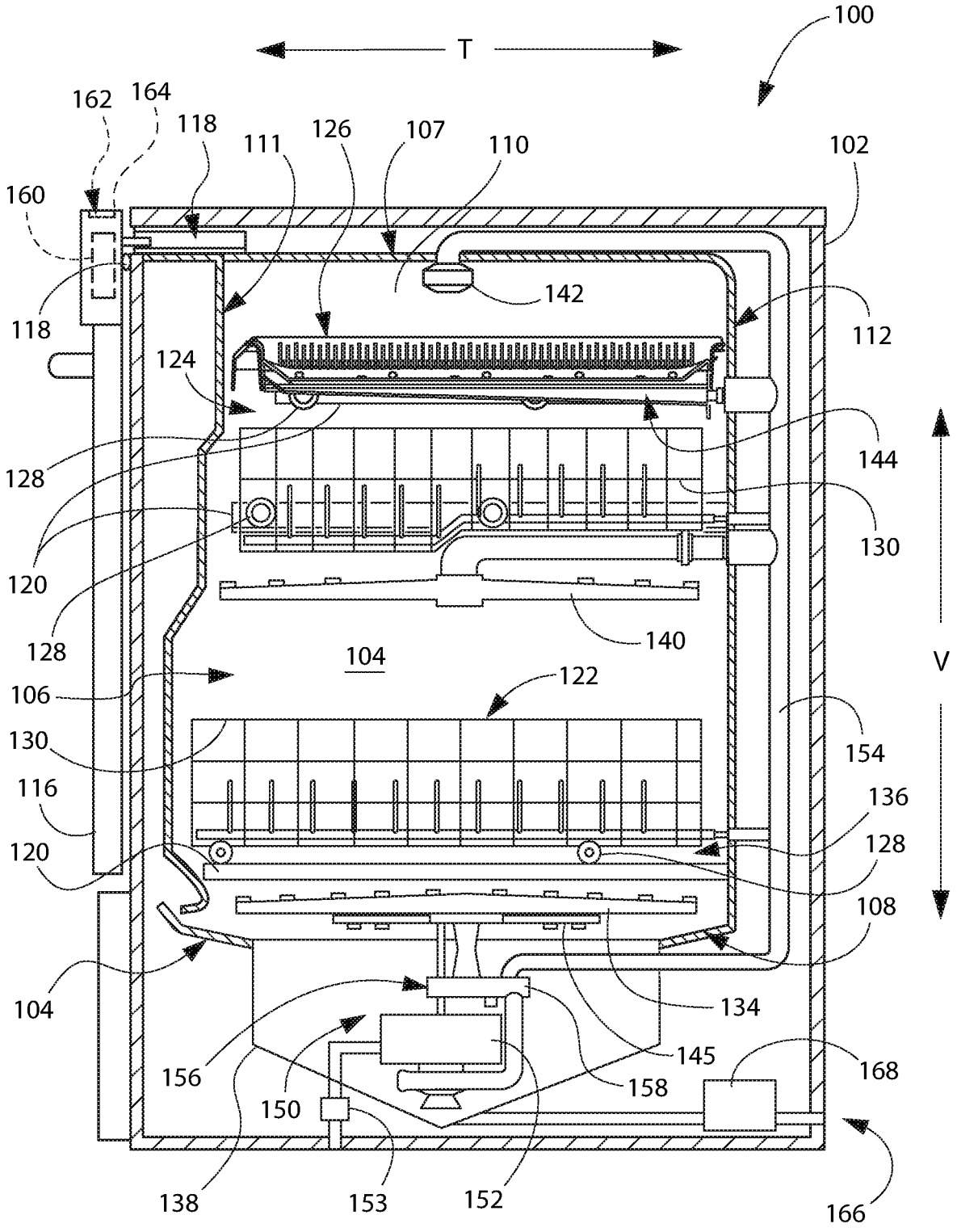
FIG. 2 provides a side, cross sectional view of the exemplary dishwashing appliance of FIG. 1.

Turning now to the figures, FIGS. 1 and 2 depict an exemplary dishwasher or dishwashing appliance (e.g., dishwashing appliance 100) that may be configured in accordance with aspects of the present disclosure. Generally, dishwasher 100 defines a vertical direction V, a lateral direction L, and a transverse direction T. Each of the vertical direction V, lateral direction L, and transverse direction T are mutually perpendicular to one another and form an orthogonal direction system.

Dishwasher 100 includes a cabinet 102 having a tub 104 therein that defines a wash chamber 106. As shown in FIG. 2, tub 104 extends between a top 107 and a bottom 108 along the vertical direction V, between a pair of side walls 110 along the lateral direction L, and between a front side 111 and a rear side 112 along the transverse direction T.

Tub 104 includes a front opening 114. In some embodiments, the dishwasher appliance 100 may also include a door 116 at the front opening 114. The door 116 may, for example, be hinged at its bottom for movement between a normally closed vertical position, wherein the wash chamber 106 is sealed shut for washing operation, and a horizontal open position for loading and unloading of articles from dishwasher 100. A door closure mechanism or assembly 118 may be provided to lock and unlock door 116 for accessing and sealing wash chamber 106.

In exemplary embodiments, tub side walls 110 accommodate a plurality of rack assemblies. For instance, guide rails 120 may be mounted to side walls 110 for supporting a lower rack assembly 122, a middle rack assembly 124, or an upper rack assembly 126. In some such embodiments, upper rack assembly 126 is positioned at a top portion of wash chamber 106 above middle rack assembly 124, which is positioned above lower rack assembly 122 along the vertical direction V.

Generally, each rack assembly 122, 124, 126 may be adapted for movement between an extended loading position (not shown) in which the rack is substantially positioned outside the wash chamber 106, and a retracted position (shown in FIGS. 1 and 2) in which the rack is located inside the wash chamber 106. In some embodiments, movement is facilitated, for instance, by rollers 128 mounted onto rack assemblies 122, 124, 126, respectively.

Although guide rails 120 and rollers 128 are illustrated herein as facilitating movement of the respective rack assemblies 122, 124, 126, it should be appreciated that any suitable sliding mechanism or member may be used according to alternative embodiments.

In optional embodiments, some or all of the rack assemblies 122, 124, 126 are fabricated into lattice structures including a plurality of wires or elongated members 130 (for clarity of illustration, not all elongated members making up rack assemblies 122, 124, 126 are shown in FIG. 2). In this regard, rack assemblies 122, 124, 126 are generally configured for supporting articles within wash chamber 106 while allowing a flow of wash liquid to reach and impinge on those articles (e.g., during a cleaning or rinsing cycle). According to additional or alternative embodiments, a silverware basket (not shown) is removably attached to a rack assembly (e.g., lower rack assembly 122), for placement of silverware, utensils, and the like, that are otherwise too small to be accommodated by the rack assembly.

Generally, dishwasher 100 includes one or more spray assemblies for urging a flow of fluid (e.g., wash liquid) onto the articles placed within wash chamber 106.

In exemplary embodiments, dishwasher 100 includes a lower spray arm assembly 134 disposed in a lower region 136 of wash chamber 106 and above a sump 138 so as to rotate in relatively close proximity to lower rack assembly 122.

In additional or alternative embodiments, a mid-level spray arm assembly 140 is located in an upper region of wash chamber 106 (e.g., below and in close proximity to middle rack assembly 124). In this regard, mid-level spray arm assembly 140 may generally be configured for urging a flow of wash liquid up through middle rack assembly 124 and upper rack assembly 126.

In further additional or alternative embodiments, an upper spray assembly 142 is located above upper rack assembly 126 along the vertical direction V. In this manner, upper spray assembly 142 may be generally configured for urging or cascading a flow of wash liquid downward over rack assemblies 122, 124, and 126.

In yet further additional or alternative embodiments, upper rack assembly 126 may further define an integral spray manifold 144. As illustrated, integral spray manifold 144 may be directed upward, and thus generally configured for urging a flow of wash liquid substantially upward along the vertical direction V through upper rack assembly 126.

In still further additional or alternative embodiments, a filter clean spray assembly 145 is disposed in a lower region 136 of wash chamber 106 (e.g., below lower spray arm assembly 134) and above a sump 138 so as to rotate in relatively close proximity to a filter assembly 210. For instance, filter clean spray assembly 145 may be directed downward to urge a flow of wash liquid across a portion of filter assembly 210 (FIGS. 3 and 4) or sump 138.

The various spray assemblies and manifolds described herein may be part of a fluid distribution system or fluid circulation assembly 150 for circulating wash liquid in tub 104. In certain embodiments, fluid circulation assembly 150 includes a circulation pump 152 for circulating wash liquid in tub 104. Circulation pump 152 may be located within sump 138 or within a machinery compartment located below sump 138 of tub 104.

When assembled, circulation pump 152 may be in fluid communication with an external water supply line (not shown) and sump 138. A water inlet valve 153 can be positioned between the external water supply line and circulation pump 152 (e.g., to selectively allow water to flow from the external water supply line to circulation pump 152). Additionally or alternatively, water inlet valve 153 can be positioned between the external water supply line and sump 138 (e.g., to selectively allow water to flow from the external water supply line to sump 138). During use, water inlet valve 153 may be selectively controlled to open to allow the flow of water into dishwasher 100 and may be selectively controlled to close to cease the flow of water into dishwasher 100. Further, fluid circulation assembly 150 may include one or more fluid conduits or circulation piping for directing wash fluid from circulation pump 152 to the various spray assemblies and manifolds. In exemplary embodiments, such as that shown in FIG. 2, a primary supply conduit 154 extends from circulation pump 152, along rear 112 of tub 104 along the vertical direction V to supply wash liquid throughout wash chamber 106.

In some embodiments, primary supply conduit 154 is used to supply wash liquid to one or more spray assemblies (e.g., to mid-level spray arm assembly 140 or upper spray assembly 142). It should be appreciated, however, that according to alternative embodiments, any other suitable plumbing configuration may be used to supply wash liquid throughout the various spray manifolds and assemblies described herein. For instance, according to another exemplary embodiment, primary supply conduit 154 could be used to provide wash liquid to mid-level spray arm assembly 140 and a dedicated secondary supply conduit (not shown) could be utilized to provide wash liquid to upper spray assembly 142. Other plumbing configurations may be used for providing wash liquid to the various spray devices and manifolds at any location within dishwashing appliance 100.

Each spray arm assembly 134, 140, 142, integral spray manifold 144, filter clean assembly 145, or other spray device may include an arrangement of discharge ports or orifices for directing wash liquid received from circulation pump 152 onto dishes or other articles located in wash chamber 106. The arrangement of the discharge ports, also referred to as jets, apertures, or orifices, may provide a rotational force by virtue of wash liquid flowing through the discharge ports. Alternatively, spray assemblies 134, 140, 142, 145 may be motor-driven, or may operate using any other suitable drive mechanism. Spray manifolds and assemblies may also be stationary. The resultant movement of the spray assemblies 134, 140, 142, 145 and the spray from fixed manifolds provides coverage of dishes and other dishwasher contents with a washing spray. Other configurations of spray assemblies may be used as well. For instance, dishwasher 100 may have additional spray assemblies for cleaning silverware, for scouring casserole dishes, for spraying pots and pans, for cleaning bottles, etc.

In optional embodiments, circulation pump 152 urges or pumps wash liquid (e.g., from filter assembly 210) to a diverter 156 (FIG. 2). In some such embodiments, diverter 156 is positioned within sump 138 of dishwashing appliance 100). Diverter 156 may include a diverter disk (not shown) disposed within a diverter chamber 158 for selectively distributing the wash liquid to the spray assemblies 134, 140, 142, or other spray manifolds. For instance, the diverter disk may have a plurality of apertures that are configured to align with one or more outlet ports (not shown) at the top of diverter chamber 158. In this manner, the diverter disk may be selectively rotated to provide wash liquid to the desired spray device.

In exemplary embodiments, diverter 156 is configured for selectively distributing the flow of wash liquid from circulation pump 152 to various fluid supply conduits—only some of which are illustrated in FIG. 2 for clarity. In certain embodiments, diverter 156 includes four outlet ports (not shown) for supplying wash liquid to a first conduit for rotating lower spray arm assembly 134, a second conduit for supplying wash liquid to filter clean assembly 145, a third conduit for spraying an auxiliary rack such as the silverware rack, and a fourth conduit for supply mid-level or upper spray assemblies 140, 142 (e.g., primary supply conduit 154).

Drainage of soiled wash liquid within sump 138 may occur, for instance, through drain assembly 166 (e.g., during or as part of a drain cycle). In particular, wash liquid may exit sump 138 through a drain outlet and may flow through a drain conduit. In some embodiments, a drain pump 168 downstream of sump 138 facilitates drainage of the soiled wash liquid by urging or pumping the wash liquid to a drain line external to dishwasher 100.

In certain embodiments, dishwasher 100 includes a controller 160 configured to regulate operation of dishwasher 100 (e.g., initiate one or more wash operations). Controller 160 may include one or more memory devices and one or more microprocessors, such as general or special purpose microprocessors operable to execute programming instructions or micro-control code associated with a wash operation that may include a wash cycle, rinse cycle, or drain cycle. The memory may represent random access memory such as DRAM, or read only memory such as ROM or FLASH. In some embodiments, the processor executes programming instructions stored in memory. The memory may be a separate component from the processor or may be included onboard within the processor. Alternatively, controller 160 may be constructed without using a microprocessor, e.g., using a combination of discrete analog or digital logic circuitry—such as switches, amplifiers, integrators, comparators, flip-flops, AND gates, and the like—to perform control functionality instead of relying upon software. It should be noted that controllers as disclosed herein are capable of and may be operable to perform any methods and associated method steps as disclosed herein.

Controller 160 may be positioned in a variety of locations throughout dishwasher 100. In optional embodiments, controller 160 is located within a control panel area 162 of door 116 (e.g., as shown in FIGS. 1 and 2). Input/output ("I/O") signals may be routed between the control system and various operational components of dishwasher 100 along wiring harnesses that may be routed through the bottom of door 116. Typically, the controller 160 includes a user interface panel/controls 164 through which a user may select various operational features and modes and monitor progress of dishwasher 100. In some embodiments, user interface 164 includes a general purpose I/O ("GPIO") device or functional block. In additional or alternative embodiments, user interface 164 includes input components, such as one or more of a variety of electrical, mechanical or electromechanical input devices including rotary dials, push buttons, and touch pads. In further additional or alternative embodiments, user interface 164 includes a display component, such as a digital or analog display device designed to provide operational feedback to a user. When assembled, user interface 164 may be in operative communication with the controller 160 via one or more signal lines or shared communication busses.

It should be appreciated that the invention is not limited to any particular style, model, or configuration of dishwasher 100. The exemplary embodiment depicted in FIGS. 1 and 2 is for illustrative purposes only. For instance, different locations may be provided for user interface 164, different configurations may be provided for rack assemblies 122, 124, 126, different spray assemblies 134, 140, 142 and spray manifold configurations may be used, and other differences may be applied while remaining within the scope of the present disclosure.

Figure 3:
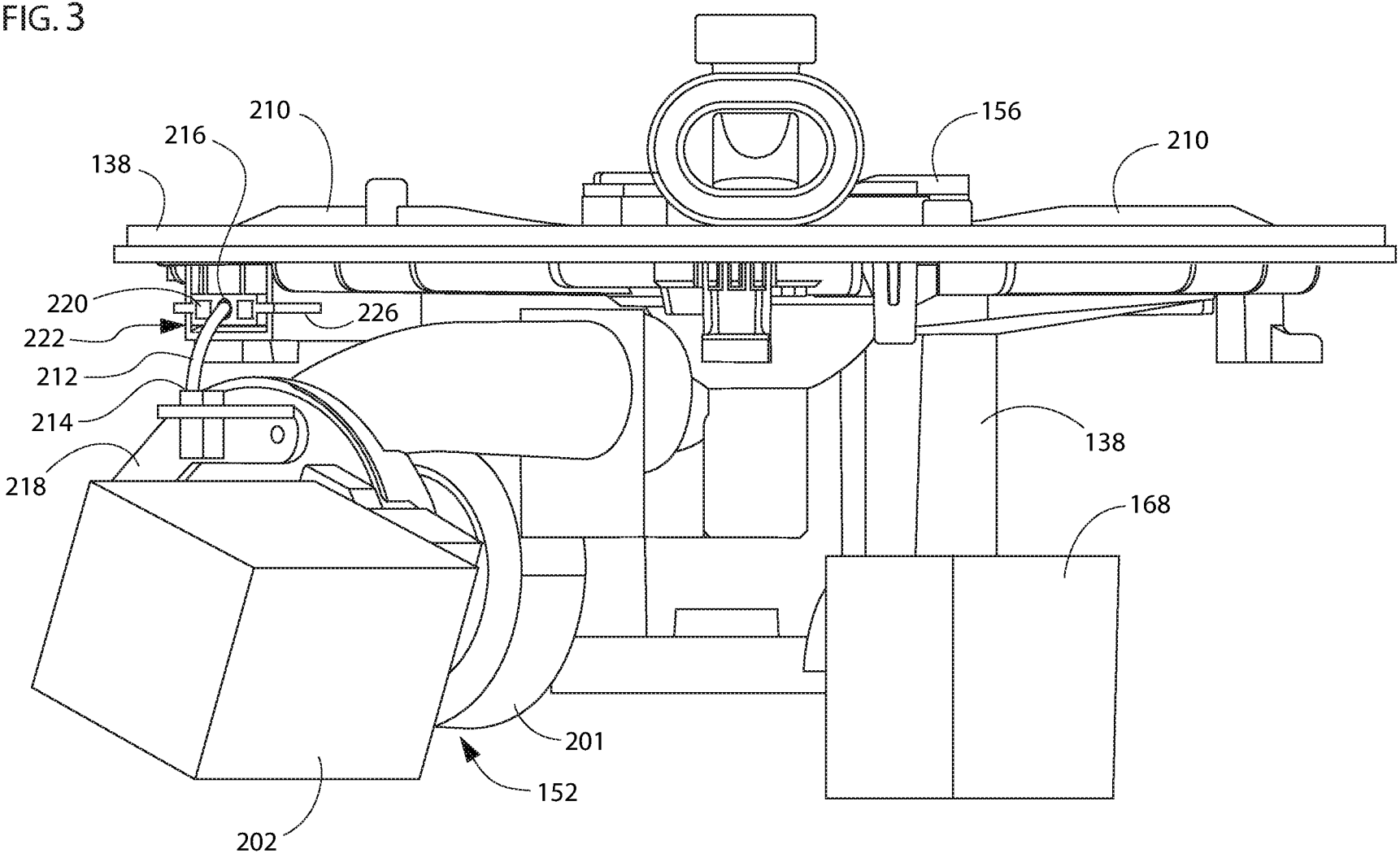
FIG. 3 provides a close up view of fluid circulation components according to one or more embodiments of the present disclosure which may be incorporated into a dishwashing appliance, such as the exemplary dishwashing appliance of FIGS. 1 and 2.
Figure 4:
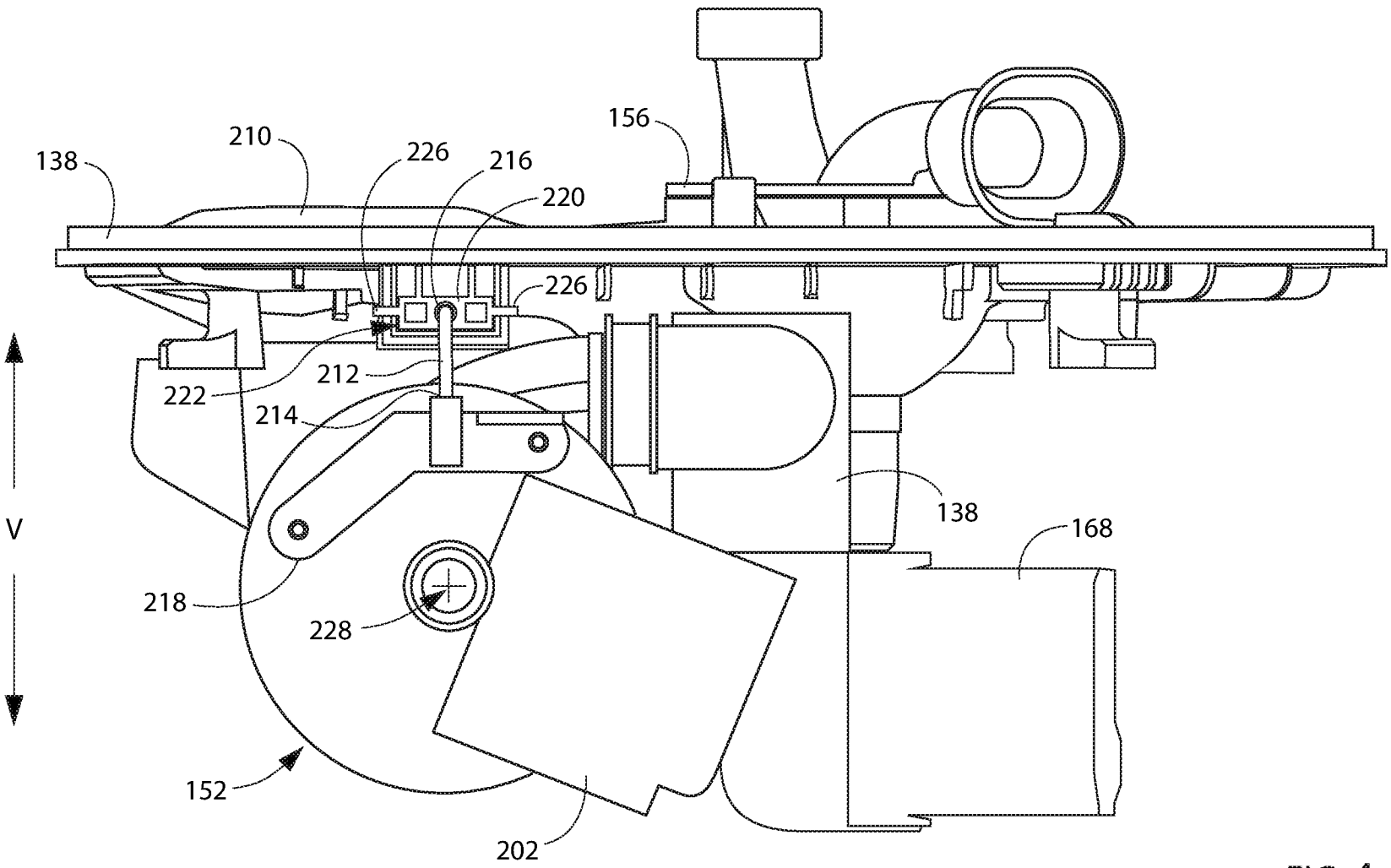
FIG. 4 provides another close up view of the fluid circulation components of FIG. 3.

Turning now to FIGS. 3 and 4, close up views of components of the fluid circulation system 150 are provided. In particular, the sump 138 and circulation pump 152 are illustrated. As shown, the circulation pump 152 may be connected to the sump 138 at a first end 201 of the circulation pump 152. The circulation pump 152 may also include a motor 202 spaced apart from the first end 201 of the circulation pump 152. In at least some embodiments, the motor 202 may comprise the majority of the weight of the circulation pump 152 and may include all or most of the moving parts of the circulation pump 152. As such, the motor 202 may be the largest contributor to vibration and noise generation during the operation of the circulation pump 152. In order to support the circulation pump 152 while also limiting or preventing transfer of vibrations from the circulation pump 152 to other components of the dishwashing appliance, the circulation pump 152 may be suspended within the dishwashing appliance 100, such as by one or more mounting cables 212.

For example, in various embodiments, the one or more mounting cables 212 may extend from the circulation pump 152, such that the circulation pump 152 is suspended along the vertical direction V from one of the tub 104 or the sump 138 by the one or more mounting cables 152. The mounting cable 212 may be in tension, e.g., may provide support to the circulation pump 152 along the vertical direction and/or along a direction which includes at least a vertical component, while permitting relative movement of the circulation pump 152 with respect to the sump 138, e.g., the mounting cable 212 may yield easily when compressed.

The mounting cable 212 may comprise any suitable material. For example, the mounting cable 212 may comprise woven or braided fibers, such as plastic fibers, such as polyester.

In some example embodiments, the mounting cable 212 may extend from a first end 214 proximate the circulation pump 152 to a second end 216 distal from the circulation pump 152. In some example embodiments, the second end 216 may be proximate the sump 138, or the second end 216 may be proximate the tub 104, e.g., connected directly to the tub 104 or a socket 222 formed on a wall of the tub 104, in other example embodiments. The first end 214 may be connected to the circulation pump 152, such as to the motor 202 of the circulation pump 152. For example, in some embodiments, the first end 214 of the mounting cable 212 may be directly connected to a bracket 218 and the bracket 218 may be directly connected to the circulation pump 152, such as to the motor 202 thereof. The bracket 218 may be directly connected to the circulation pump 152 by fasteners such as screws or other suitable fasteners.

Figure 5:
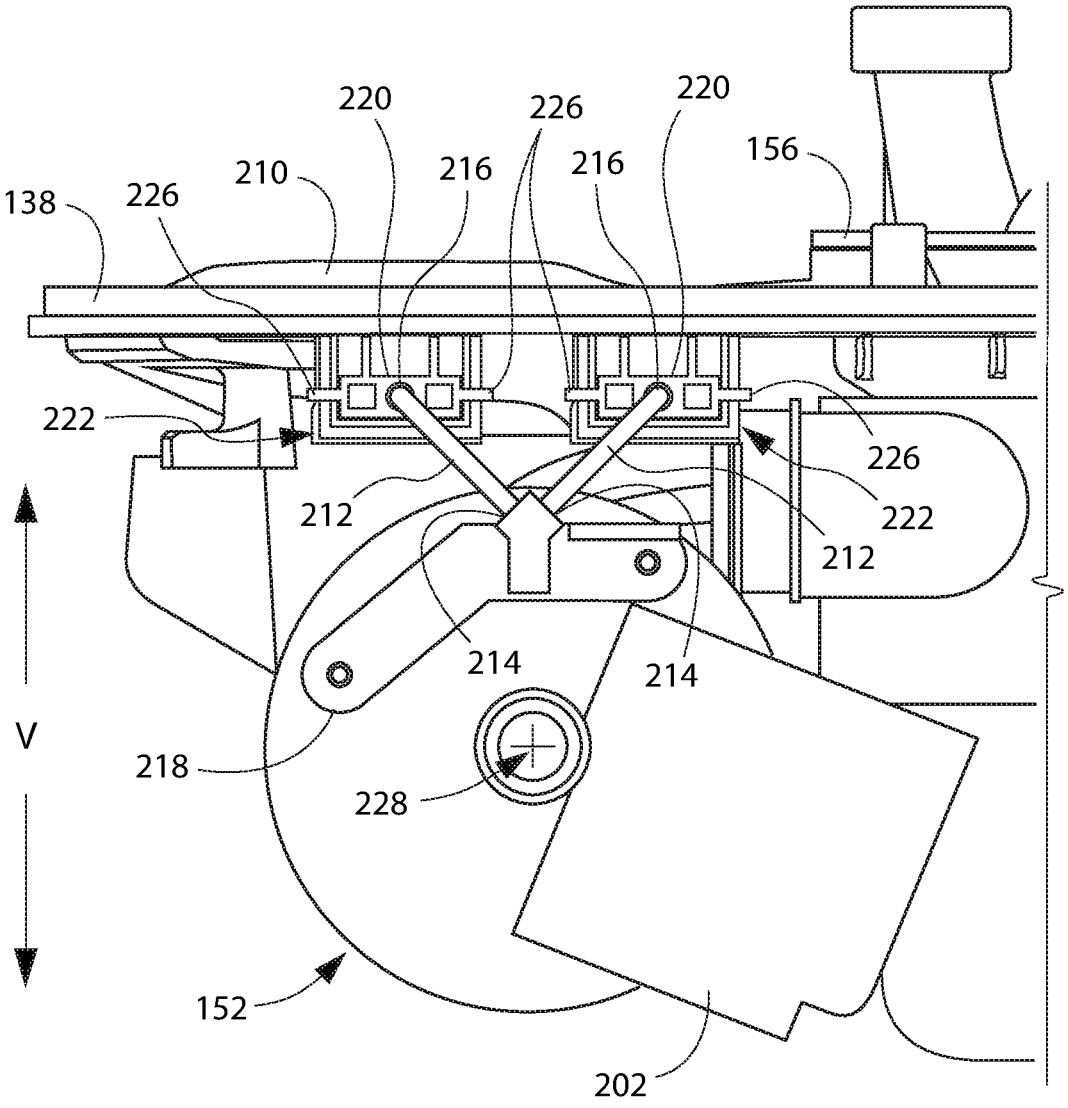
FIG. 5 provides a close up view of fluid circulation components according to one or more embodiments of the present disclosure which may be incorporated into a dishwashing appliance, such as the exemplary dishwashing appliance of FIGS. 1 and 2.

In some embodiments, e.g., as illustrated in FIGS. 3 through 5, the bracket 218 may be integrally joined with the mounting cable 212, where "integrally joined" is used to refer to constructions where the mounting cable 212 is bonded to or joined with the bracket so as to form an integrated and unitary whole consisting of a one-piece construction without the use of mechanical fasteners. For example, the bracket 218 may comprise a plastic material and may be overmolded onto and over the mounting cable 212.

The second end 216 of the mounting cable 212 may have a connector affixed thereon. For example, in some embodiments, the connector may comprise a clip 220. The clip 220 may be integrally joined to the second end 216 of the mounting cable 212, as described above regarding the bracket 218 and the first end 214, such as by overmolding the clip 220 onto the second end 216 of the mounting cable 212. The clip 220 may be removably received into a socket 222. The socket 222 may be formed on the sump 138 or on the tub 104. The clip 220 may include at least one barb 224 which engages the socket 222 to hold the clip 220 therein. For example, in some embodiments, the clip 220 may include at least one arm 226 with a barb 224 formed on the arm 226, whereby the clip 220 may be released from the socket 222 by flexing the arm 226 to disengage the barb 224 from the socket 222.

As illustrated in FIG. 5, in some example embodiments, the circulation pump 152 may be suspended by two mounting cables, e.g., the dishwashing appliance may include a first mounting cable 212 and a second mounting cable 212. The second mounting cable 212 may extend from a first end 214 at the circulation pump 152 to a second end 216 at the sump 138 or tub 104, similar to the first end 214 and second end 216 of the first mounting cable 212 as described above. In some example embodiments, the first end 214 of the first mounting cable 212 and the first end 214 of the second mounting cable 212 may be adjacent to each other. For example, the bracket 218 may be overmolded on both the first end 214 of the first mounting cable 212 and the first end 234 of the second mounting cable 232. Also in such example embodiments, the second end 216 of the first mounting cable 212 and the second end 216 of the second mounting cable 212 may be spaced apart from each other.

For example, in embodiments where the first ends 214 are adjacent and the second ends 216 are spaced apart, the first mounting cable 212 and the second mounting cable 212 may thereby form a V-shape. In such embodiments, the first mounting cable 212 and the second mounting cable 232 may form an angle therebetween. The angle may be about ninety degrees, e.g., "about" includes angles within ten degrees of the stated angle, such that "about ninety degrees" may include angles from eighty to one hundred degrees. In various embodiments, the angle between the first mounting cable 212 and the second mounting cable 212 may be between about sixty degrees and about one hundred twenty degrees, such as between about seventy-five degrees and about one hundred and five degrees, such as about ninety degrees.

In various embodiments, the second end 216 of the mounting cable 212 and/or the second ends 216 of the mounting cables 212 may be positioned above the center of gravity of the circulation pump 152 and/or of the motor 202 of the circulation pump 152. For example, in some embodiments, the second end 216 of the mounting cable 212 may be positioned directly above the center of gravity of the motor 202 along the vertical direction. As another example, in some embodiments which include a first and second mounting cable 212, the second ends 216 of the mounting cables 212 may be centered on a point that is directly above the center of gravity 228 of the motor 202 along the vertical direction. For example, the second ends 216 may be spaced apart along a line perpendicular to the vertical direction V, and the center point of that line may be positioned directly above the center of gravity 228 of the motor 202 along the vertical direction. For example, the second end 216 of the first mounting cable 212 and the second end 216 of the second mounting cable 212 may be equidistant from the center of gravity 228 of the motor 202 of the circulation pump 152.

Figure 6:
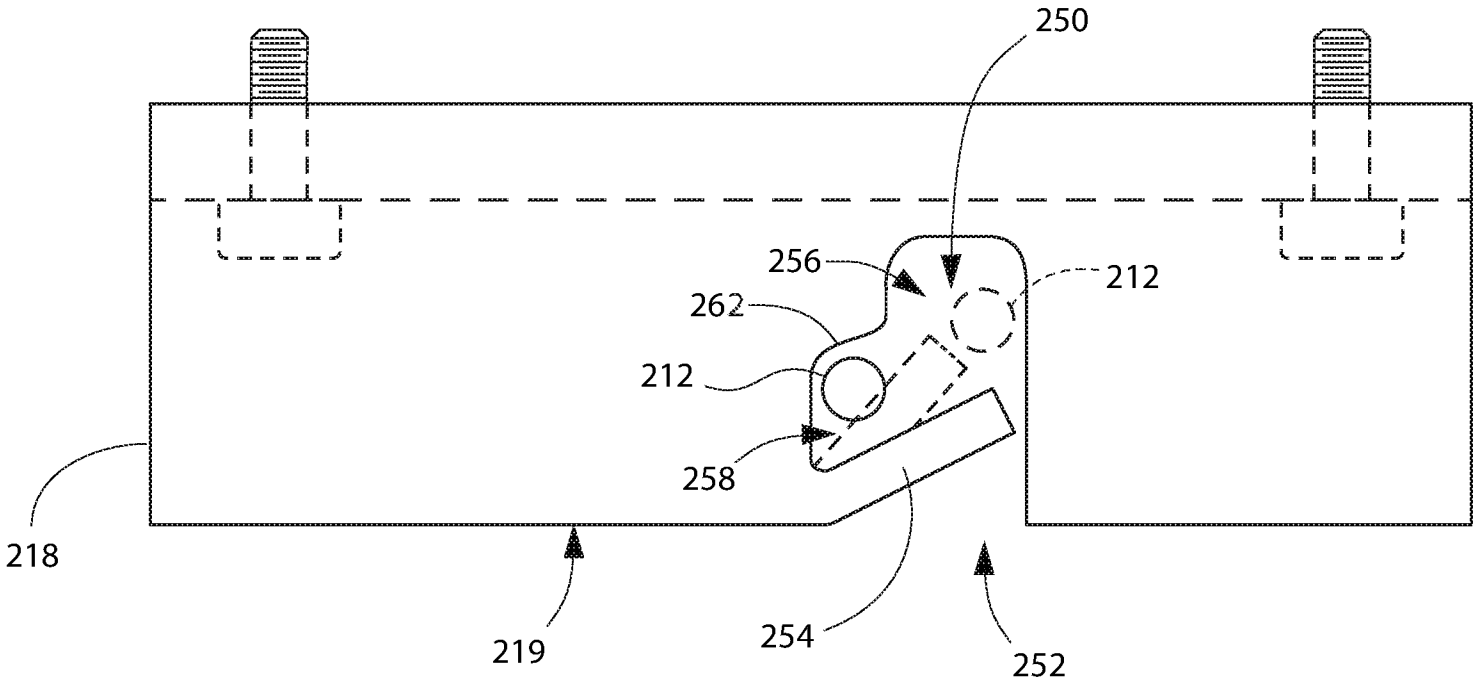
FIG. 6 provides a top-down view of a mounting bracket for fluid circulation components according to one or more embodiments of the present disclosure.
Figure 7:
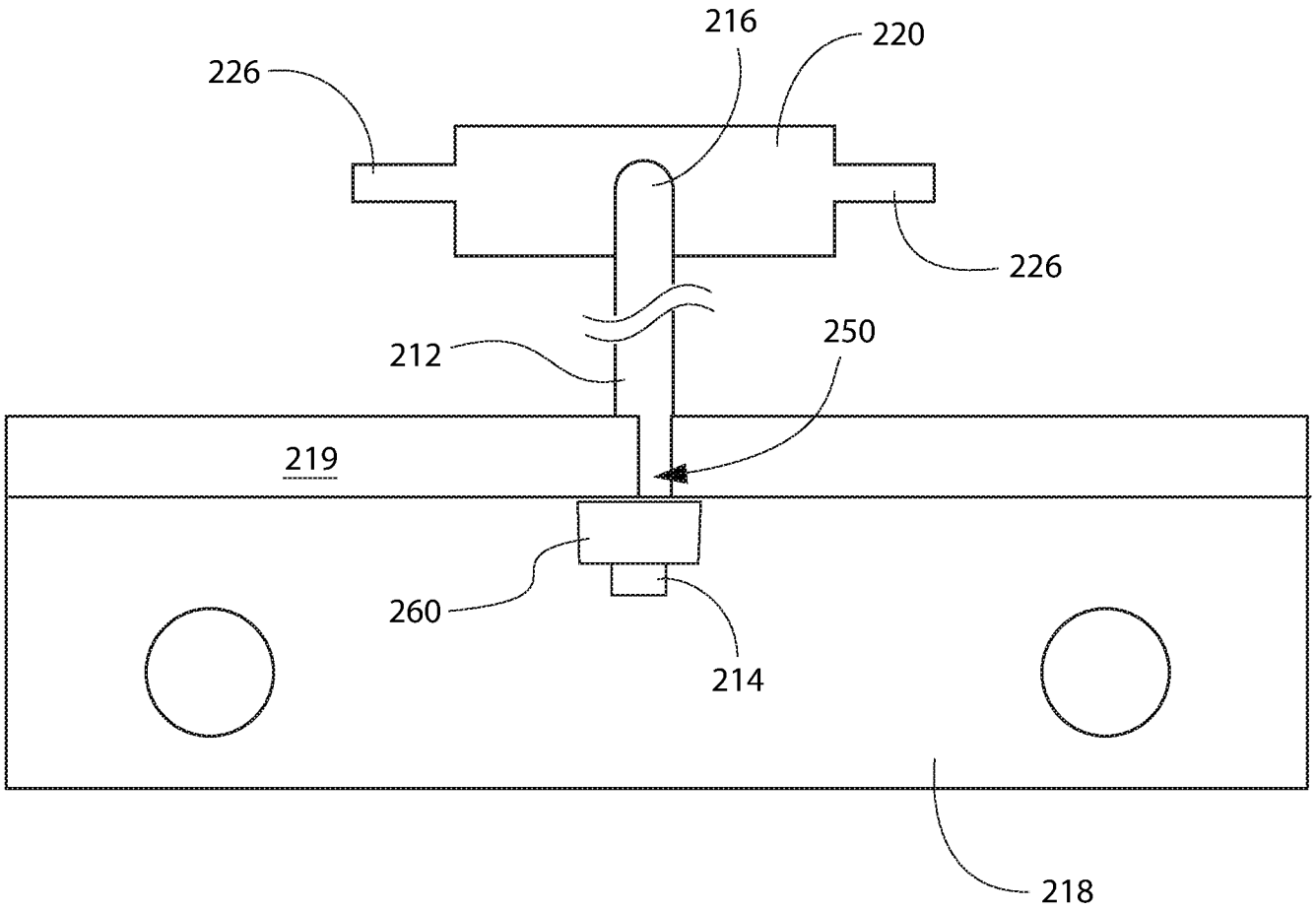
FIG. 7 provides a front view of the mounting bracket of FIG. 6.
Figure 8:
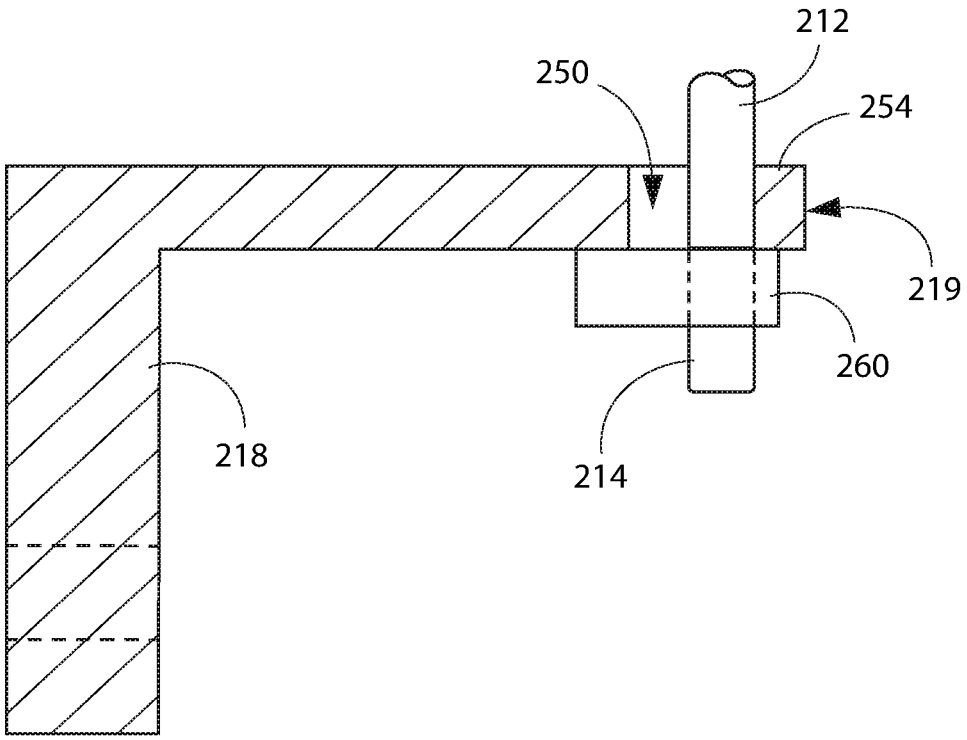
FIG. 8 provides a side section view of the mounting bracket of FIG. 6.

Turning now to FIGS. 6 through 8, in some embodiments, the or each mounting cable 212, e.g., the first end(s) 214 thereof, may be received within a serpentine groove 250 of the mounting bracket 218. As shown in FIG. 6, the groove 250 may extend into the bracket 218 from an outer face 219 of the bracket 218. The groove 218 may define a void within the bracket 218 and the void may be configured to receive a portion of the mounting cable 212. In particular, the groove 250 may include and be accessible via an opening 252 formed in the outer face 219 of the bracket 218. In some embodiments, e.g., as illustrated in FIG. 6, a flexible tab 254 may be provided at the opening 252 of the groove 250. The flexible tab 254 may be pliable in order to move from a locked position (solid lines in FIG. 6) where the tab 254 prevents or inhibits the mounting cable 212 from exiting the groove 250 to an open position (dashed lines in FIG. 6) where the tab 254 permits the cable 212 to enter the groove 250. For example, the flexible tab 254 may be flexible in a single direction, such as to yield (move to the open position) when the cable 212 is pressed into the groove 250 while not moving outward (e.g., away from the groove 250 and/or towards the outer face 219 of the bracket 218) when the cable 250 is urged out of the groove 250.

As illustrated in FIG. 6, the groove 250 may define a curved, such as serpentine, shape, e.g., the groove 250 may include a first portion 256 and a second portion 258 which collectively define a serpentine curved wall 262 of the groove 250. In some embodiments, the cable 212 may enter the groove 250 via the entrance 252, passing the tab 254 while the tab 254 is in the dashed-line position in FIG. 6. More particularly, the cable 212 may enter the groove 250 at the first portion 256 of the groove, e.g., as illustrated by the dashed-line position of the cable 212 in FIG. 6, such that the dashed-line position of the tab 254 and the dashed-line position of the cable 212 in FIG. 6 generally correspond with one another, e.g., the tab 254 will deflect to the dashed-line position while the cable 212 passes through the entrance 252 of the groove 250 and the cable 212 then reaches the dashed-line position of the cable 212. The cable 212 may then be guided within the groove 250 from the first portion 256 to the second portion 258 by the serpentine curved wall 262, until the cable 212 is held in place within the second portion 258 of the groove 250, e.g., between the serpentine curved wall 262 and the tab 254 when the cable 212 and the tab 254 are each in the respective position illustrated in solid lines in FIG. 6.

As illustrated in FIGS. 7 and 8, a stop 260 may be attached to the second end 214 of the mounting cable 212. In various embodiments, the stop 260 may be bonded or adhered to the second end 214 of the mounting cable 212, such as with glue or adhesive. In some embodiments, the stop 260 may be integrally joined, such as overmolded onto, with the second end 214 of the mounting cable 212. As may be seen in FIGS. 7 and 8, the stop 260 may be larger than the groove 250, such that the stop 260 will bear against the bracket 218 and prevent or inhibit movement of the cable 212 up and out of the groove 250.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A dishwashing appliance defining a vertical direction, the dishwashing appliance comprising:

a tub defining a wash chamber for receipt of articles for washing;

a sump positioned at a bottom of the wash chamber for receiving fluid from the wash chamber;

a circulation pump connected to the sump;

a first mounting cable extending from the circulation pump, wherein the first mounting cable extends from a first end at the circulation pump to a second end at one of the sump or the tub; and a second mounting cable extending from the circulation pump, wherein the second mounting cable extends from a first end at the circulation pump to a second end at the one of the sump or the tub, whereby the circulation pump is suspended along the vertical direction by the first mounting cable and the second mounting cable, wherein the first end of the first mounting cable and the first end of the second mounting cable are adjacent to each other and the second end of the first mounting cable and the second end of the second mounting cable are spaced apart from each other, whereby the first mounting cable and the second mounting cable form a V-shape.

2. The dishwashing appliance of claim 1, wherein the first mounting cable and the second mounting cable form an angle therebetween, and wherein the angle is about ninety degrees.

3. The dishwashing appliance of claim 1, wherein circulation pump comprises a motor, and wherein the second end of the first mounting cable and the second end of the second mounting cable are equidistant from a center of gravity of the motor of the circulation pump.

4. The dishwashing appliance of claim 1, wherein the first end of the first mounting cable is integrally joined to a bracket and the bracket is connected to the circulation pump.

5. The dishwashing appliance of claim 4, wherein the bracket is overmolded on the first end of the first mounting cable.

6. The dishwashing appliance of claim 1, wherein the second end of the first mounting cable is integrally joined to a clip and the clip is connected to one of the sump or the tub.

7. The dishwashing appliance of claim 1, wherein the first end of the first mounting cable is received within a groove in a bracket and the bracket connected to the circulation pump.

8. The dishwashing appliance of claim 7, wherein the groove in the bracket comprises a serpentine curved wall.

9. A dishwashing appliance, comprising:

a tub defining a wash chamber for receipt of articles for washing;

a sump positioned at a bottom of the wash chamber for receiving fluid from the wash chamber;

a circulation pump connected to the sump;

a first mounting cable extending from the circulation pump, wherein the first mounting cable extends from a first end at the circulation pump to a second end at the one of the sump or the tub; and a second mounting cable extending from the circulation pump, wherein the second mounting cable extends from a first end at the circulation pump to a second end at the one of the sump or the tub, whereby the circulation pump is suspended from one of the tub or the sump by the first mounting cable and the second mounting cable, wherein the first end of the first mounting cable and the first end of the second mounting cable are adjacent to each other and the second end of the first mounting cable and the second end of the second mounting cable are spaced apart from each other, whereby the first mounting cable and the second mounting cable form a V-shape.

10. The dishwashing appliance of claim 9, wherein the first mounting cable and the second mounting cable form an angle therebetween, and wherein the angle is about ninety degrees.

11. The dishwashing appliance of claim 9, wherein circulation pump comprises a motor, and wherein the second end of the first mounting cable and the second end of the second mounting cable are equidistant from a center of gravity of the motor of the circulation pump.

12. The dishwashing appliance of claim 9, wherein the first end of the first mounting cable is integrally joined to a bracket and the bracket is connected to the circulation pump.

13. The dishwashing appliance of claim 12, wherein the bracket is overmolded on the first end of the mounting cable.

14. The dishwashing appliance of claim 9, wherein the second end of the first mounting cable is integrally joined to a clip and the clip is connected to the one of the sump or the tub.

15. The dishwashing appliance of claim 9, wherein the first end of the first mounting cable is received within a groove in a bracket and the bracket is connected to the circulation pump.

16. The dishwashing appliance of claim 15, wherein the groove in the bracket comprises a serpentine curved wall.

* * * * *